US011022109B2

(12) United States Patent
Khachaturov

(10) Patent No.: US 11,022,109 B2
(45) Date of Patent: Jun. 1, 2021

(54) DOUBLE ACTING LINEAR ELECTRICAL SUBMERSIBLE PUMP AND METHOD FOR ITS OPERATION

(71) Applicant: Dmytro Khachaturov, Kharkov (UA)

(72) Inventor: Dmytro Khachaturov, Kharkov (UA)

( * ) Notice: Subject to any disclaimer, the term of this patent is extended or adjusted under 35 U.S.C. 154(b) by 174 days.

(21) Appl. No.: 16/051,921

(22) Filed: Aug. 1, 2018

(65) Prior Publication Data

US 2019/0219048 A1 Jul. 18, 2019

(30) Foreign Application Priority Data

Jan. 17, 2018 (UA) ..... a 2018 00500
Jan. 18, 2018 (UA) ..... u 2018 00501
Mar. 26, 2018 (RU) ..... RU2018110666

(51) Int. Cl.

| | |
|---|---|
| ***F04B 47/06*** | (2006.01) |
| ***E21B 43/12*** | (2006.01) |
| ***F04B 53/14*** | (2006.01) |
| ***F04B 19/22*** | (2006.01) |
| ***F04B 5/02*** | (2006.01) |
| ***F04B 17/03*** | (2006.01) |
| ***F04B 53/20*** | (2006.01) |

(52) U.S. Cl.

CPC ..... *F04B 47/06* (2013.01); *E21B 43/128* (2013.01); *F04B 5/02* (2013.01); *F04B 17/03* (2013.01); *F04B 19/22* (2013.01); *F04B 53/144* (2013.01); *F04B 53/20* (2013.01)

(58) Field of Classification Search

CPC ..... F04B 47/06; F04B 53/20; F04B 53/144; F04B 53/126; F04B 53/06; F04B 53/12; F04B 53/14; F04B 53/16; F04B 53/1087; F04B 53/1002; F04B 19/22; F04B 5/02; F04B 17/03; F04B 7/04; F04B 19/11; E21B 43/128; E21B 43/126; E21B 43/121; E21B 43/122; E21B 34/08; F16K 15/02; F16K 15/021; F16K 15/04; F16K 15/06

USPC ..... 417/555.2

See application file for complete search history.

(56) References Cited

U.S. PATENT DOCUMENTS 3,981,285 A * 9/1976 Schueler ..... F02D 1/00 123/559.1
6,173,768 B1 * 1/2001 Watson ..... E21B 34/06 166/105.5
2013/0284423 A1 * 10/2013 Morrison ..... E21B 43/38 166/105.5

(Continued)

*Primary Examiner* — Essama Omgba
*Assistant Examiner* — Christopher J Brunjes

(57) ABSTRACT

The invention relates to reciprocating piston pumps, in particular, to a reciprocating double acting well pump driven by a linear submersible permanent magnet motor. The essence of the claimed invention lies in the fact that the upper pumping plunger pair of a pump module of a double acting linear electric submersible pumping unit is configured to intake a double volume of a borehole fluid sufficient for one operating cycle and contains delivery traveling and inlet fixed valves with a directional pusher, closing by straight oncoming flow of the borehole fluid. Also a separator of downward and upward flows of the borehole fluid with low and high-pressure passages is installed above a cylinder of the pumping plunger pair. Wherein the low-pressure passages are performed in fluid communication with a borehole fluid delivery port from an annulus, containing a filtration and gravitational gas separation zone.

3 Claims, 3 Drawing Sheets

(56) References Cited

U.S. PATENT DOCUMENTS

| | | | | |
|---|---|---|---|---|
| 2015/0176574 | A1* | 6/2015 | DeArman | F04B 47/12 417/53 |
| 2016/0312785 | A1* | 10/2016 | Meyer | F04D 29/106 |
| 2016/0369788 | A1* | 12/2016 | Brown | F04B 47/06 |

* cited by examiner

DOUBLE ACTING LINEAR ELECTRICAL SUBMERSIBLE PUMP AND METHOD FOR ITS OPERATION

CROSS-REFERENCES TO RELATED APPLICATIONS

The present patent application claims priority to Ukrainian patent application a201800500 filed Jan. 17, 2018, Ukrainian Utility Model application u201800501 filed Jan. 18, 2018, Russian Utility Model application 2018110666 filed Mar. 26, 2018.

FIELD OF INVENTION

The invention relates to reciprocating piston pumps, in particular, to a reciprocating double acting well pump driven by a linear submersible permanent magnet motor.

BACKGROUND

General approach to recovered borehole fluid ascent to the surface includes utilization of a displacement pump driven by a mechanical drive.

There exists a distinction made for sucker-rod pumps, reciprocating of which is provided by a sucker-rod string. The sucker-rod pump unit consists of the displacement pump located at the bottom of an oil well tubing. The unit includes a piston moving linearly within the oil well tubing by means of steel or fiberglass rods. Linear movement of the pump rods is transmitted from the surface by means of a beam-type construction, designed to ascend and descend alternately the pump rods, thereby ensuring reciprocating movement of the pump piston.

The main disadvantage of this design is that most of wells are not straight and can deviate in different directions on their way to a production zone. Presence of deviations in a well direction causes friction between the pump rod and oil well tubing, which leads to their excessive wear and tear. Which results in high cost of structural elements replacement. In addition, presence of friction between the pump rod and oil well tubing requires utilization of motors of a higher efficiency.

An ordinary solving of this problem involves utilization of well pumps installed in the lower part of the oil well tubing. This kind of equipment includes downhole reciprocating double-acting pumps. A generic aspect of such pumps is that both strokes of a pump plunger are operational in order to maximize the efficiency of an electric motor during the reciprocating movement of the well pump. Major disadvantages of currently known pumping plants include significant losses of borehole fluid, malfunctions associated with presence of gas and mechanical impurities in the borehole fluid and restrictions regarding operability in wells with an inclination angle of more than 40°.

Claim for Invention US20150176574A1 dated Jun. 25, 2015, sets out a reciprocating downhole sucker-rod pump connected to a motor connector, for example, by a threaded or bolted flange couplings. The pump comprises an enclosure cylindrical and concentric on the axis. The pump includes an upper valve unit, comprising an upper intake port, and a lower valve unit; the cylinder is located concentrically between the upper valve unit and the lower valve unit within the pump enclosure. The upper valve unit is connected to the oil well tubing and has a pump outlet passage, that intercommunicates with an inner part of a pipeline. The enclosure and cylinder form a pump annular space between them. The pump piston or plunger interacts with the inner diameter of the cylinder providing ability of sliding. A crosshead beam is connected to the lower end of the plunger, causing reciprocating of the plunger with a moving part of the motor.

Depending on the plunger stroke direction, the upper or the lower valve unit is activated, which provides supply of borehole fluid into a pump cylinder cavity, upon which it is brought to the surface by means of an annular channel in the oil well tubing.

Disadvantages of the described technical solution may include complexity of the design with arrangement of four valves and additional connecting-rod elements, which increases the installation dimensions and makes it complex to be manufactured.

U.S. Pat. No. 6,817,409 dated Nov. 16, 2004, Int. Cl. F04B 11/00, sets out a double-stroke piston pump installed in a borehole, driven by a linear drive, comprising an enclosure and a pumping plunger pair cylinder placed inside of it, with an annular cavity located in-between. The pump is capable to extrude the volume of the pumping plunger pair cylinder, by means of reciprocal motion of the plunger with a traveling valve connected to a moving part of the linear drive, providing that both strokes of the plunger are operational. According to the described design, the pump contains the plunger, traveling in reaction to the linear drive reciprocating. The pump is configured to supply the first volume of liquid to a well during an upward operational stroke of the pump and the second volume of fluid during a downward stroke. The pump piston is installed between the enclosure and the plunger so as to form an annular space between the plunger and the piston and an annular space between the enclosure and the piston. Also, the plunger design provides at least one through hole located between the piston and the lower portion of enclosure in order to create a fluid communication between a piston channel and the annular space arranged between the enclosure and the piston. Consequently, the fluid is being forced out from the annular space through at least one through hole of the plunger into the oil well tubing string during the plunger stroke.

Disadvantages of the described technical solution may include presence of a complex system of channels designed for fluid transmission, as well as a small volume of the borehole fluid supplied through the holes of the plunger. The disadvantages may also include the borehole fluid intake performed without gas withdrawal and filtration.

RU139596 Utility Model Patent dated Apr. 20, 2014, Int. Cl. F04B47/08, sets out a double-acting well pump driven by a linear drive containing a pump module with a reversing and inlet valves, as well as two successively mounted plungers of different diameters, driven by the linear drive and capable to provide an ability to force the internal volume of the borehole fluid out by means of reciprocal motion of the linear drive. One of said plungers is equipped with a traveling valve and forms an annular cavity with a pump module enclosure, providing that both plunger strokes are operational. The pair of plungers of the pump module are interconnected with a connecting rod. Diameter of the upper plunger cylinder is greater than diameter of the lower plunger cylinder. The upper plunger of a greater diameter is hollow and contains an installed discharge valve, the lower plunger of a smaller diameter is monolithic and connected by a polished rod with the working pump drive. The cavity located above the hollow plunger of a greater diameter is connected to a drill-string-borehole annulus through a suction valve. The cavity located under the monolithic plunger of a smaller diameter is permanently connected to the drill-string-borehole annulus. The cavity located under the upper hollow plunger of a greater diameter is connected to the cavity located above the lower monolithic plunger of a smaller diameter and with a bypass passage formed by a shell enclosing the upper larger cylinder from the outside; the bypass passage is connected to a pump flowout line.

Disadvantages of the described technical solution may include presence of harmful effect of gas and mechanical impurities contained in the borehole fluid due to filtration and gas separation non-availability, complexity of the construction due to a spaced-apart arrangement of the plunger pairs with a system of channels in valve units for fluid transmission, which can lead to their wax precipitation, also the pumping unit design does not allow its utilization in wells with an inclination angle of more than 40°.

The claimed invention aims solving a technical problem constituting creation of the double acting linear electric submersible pumping unit with increased productivity and simplified construction actuated by the linear drive in the form of a movable part (slider) of linear submersible permanent magnet motor, providing a possibility of raising the borehole fluid without no-load operation of the movable part and a possibility of operation in horizontal wells.

SUMMARY

The technical result achieved from the invention embodiment consists in simplifying of the construction with simultaneous increase in pumping unit productivity, reducing concentration of mechanical impurities of the borehole fluid and non-associated gas at a pump module section, as well as in enhancement of the pumping unit operation in wells with an inclination angle of more than 40°, particularly in horizontal wells.

The essence of the claimed invention lies in a fact that an upper plunger of a pump module of a double acting linear electric submersible pumping unit is configured to hold (or contain) a double volume of borehole fluid sufficient for one operating cycle and contains the delivery traveling and inlet fixed spool valves, with a directional pusher rod, closing by straight oncoming flow of borehole fluid. Also a separator of downward and upward flows of the borehole fluid with low and high-pressure passages is installed above the cylinder of the upper plunger. Wherein the low-pressure passages are performed in fluid communication with a borehole fluid delivery channel from an annular space, containing a filtration and a gravitational gas separation zone. Volume of the gravitational gas separation zone is greater or equal to a volume of one operating cycle of the pump module. Wherein a lower plunger is partially accommodated in the upper plunger cavity while forming an annular cavity and is capable to execute labyrinth sealing of the linear drive movable part.

An annulus located between the pump module enclosure and an outer surface of the cylinder of the pumping plunger pair is connected to an annular cavity formed by the lower plunger by means of a common volume arranged between the pair of plungers.

The borehole fluid filtration zone is arranged around the lower plunger; the borehole fluid periodically fills a cavity in the pump module enclosure formed by the difference in radial dimensions of the lower plunger and the linear drive connected to said plunger.

A method of operation of the double acting linear electrical submersible pump comprises:

(a) lowering the pump module connected to the linear drive into a well;

(b) filling it with the borehole fluid and displacing of the borehole fluid subsequently into the tubing string cavity by reciprocating of the pair of plungers connected to the movable part of the linear drive, wherein both plunger strokes are operating;

(c) performing the borehole fluid intake from the annulus during the downward stroke with open inlet valve and closed traveling valve of the upper plunger, simultaneously filling the double volume of the cylinder of the upper plunger required for one operating cycle;

(d) pushing the borehole fluid through the filtration zone and the gravity gas separation zone arranged in the borehole fluid delivery channel, provided that its volume is larger or equal to the volume of one operating cycle of the pump module;

(e) displacing the borehole fluid from the annular cavity located under the upper plunger simultaneously during the downward stroke by means of its common volume arranged between the plungers and the annular cavity connected therewith, located between the pump module enclosure and the outer surface of the upper plunger cylinder, towards the high-pressure channels arranged within the separator of the descending and ascending flows of the borehole fluid installed above the upper plunger cylinder, and further through the reversing valve into the tubing string;

(f) inverting the borehole fluid flow on the reverse stroke, namely upwards with closed inlet valve and open traveling valve of the upper plunger, under influence of a pressure created within the cavity of upper plunger cylinder towards the common volume located between the pair of plungers;

(g) feeding it towards the tubing string by analogy with the downward stroke, herewith the traveling, inlet and reversing spool valves are closed by straight oncoming flow of the borehole fluid.

BRIEF DESCRIPTION OF THE DRAWINGS

The essence of the claimed invention is explained, but is not limited to the following images:

DETAILED DESCRIPTION OF THE PREFERRED EMBODIMENT

Figure 1:
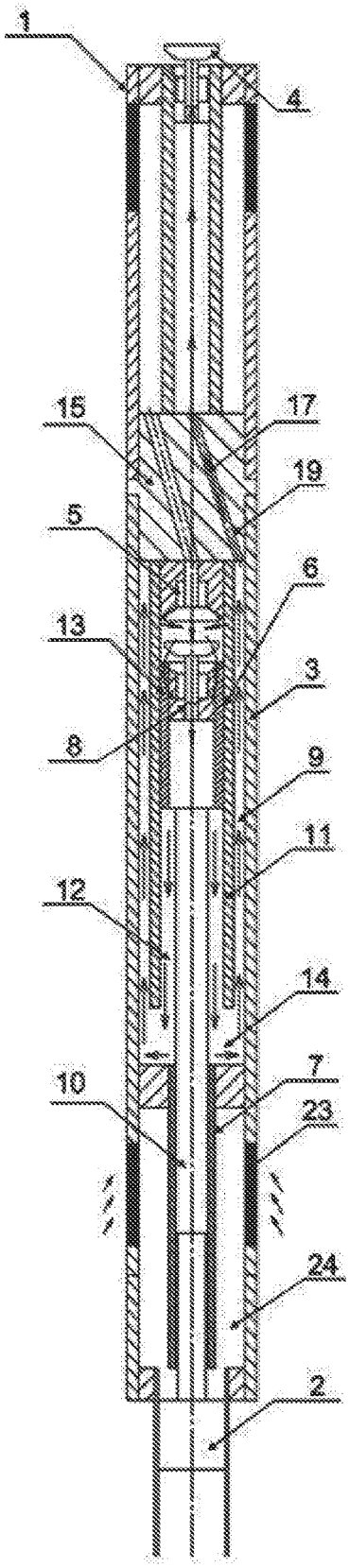
FIG. 1 is a functional diagram of the pump module during the upward stroke.
Figure 2:
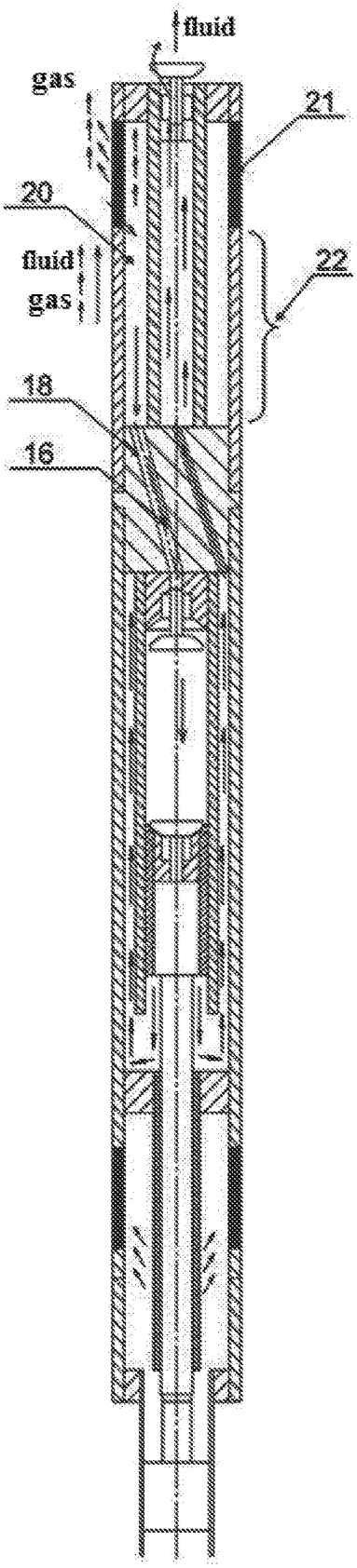
FIG. 2 is a functional diagram of the pump module during the downward stroke.

FIGS. 1, 2 show pump module 1 of the double acting linear electrical submersible pump installable into a wellbore and driven by means of the linear drive executed as a movable part (slider) 2 of a linear submersible permanent magnet electric motor (not shown on the illustration).

Pump module 1 contains enclosure 3 of a high pressure and of a cylindrical form with a reversing valve 4 and an inlet valve 5. A pair of plungers 6, 7 are arranged on-line inside of the enclosure, driven by the linear drive capable to force out the internal volume of the borehole fluid due to the reciprocal motion of the linear drive. Upper pumping plunger 6 contains delivery traveling gravity or spool valve 8 and inlet fixed gravity or spool valve 5 installed in the upper portion of its cylinder, equipped with the pusher rod, and both of said valves are closed by the oncoming flow of the borehole fluid. Also the upper plunger 6 forms a first annular cavity 9 with the pump module enclosure. Stroke of the pump module plungers in both directions is operational.

Upper plunger 6 with integrated traveling delivery valve 8 and fixed inlet valve 5 is connected to a lower plunger 7 of a smaller diameter by means of plunger rod 10. The mentioned plunger 7 is also designed as the labyrinth sealing to prevent losses of the borehole fluid and protect the linear drive from abrasive wear due to mechanical impurities effect and allows to increase the plunger stroke of the upper plunger with increasing the pump module productivity.

Lower plunger 7 is connected to linear drive 2, and its plunger rod 10 partially located inside of the cavity of cylinder 11 of upper plunger 6 with forming a second annular cavity 12 under its plunger rod 13. Herewith said second annular cavity 12 is executed in fluid communication with the first annular cavity 9, arranged between the pump enclosure and outer surface of the upper plunger cylinder 11 by means of common volume 14, arranged between the pair of plungers 6, 7. Flow separator 15 of downward flaw 16 and upward flaw 17 of the borehole fluid with low-pressure channel 18 and high-pressure channel 19 respectively is installed above the cylinder of upper plunger 6. Wherein the low-pressure channel is executed in fluid communication with a delivery channel 20 of borehole fluid feed from the annulus, that includes filtration zone 21 with arranged filters.

A volume of gravitational gas separation zone 22 is greater or equal to the volume of one operating cycle of pump module 1. The volume of one operating cycle is determined by the volume of fluid displaced during a single upward and downward stroke of plungers of the pumping module. Additional reversing valve 4 preventing a drain back of the borehole fluid from the oil well tubing is installed at an output of the pump module in a place of its connection to the oil well tubing string (not shown on the figures). Traveling valve 8, inlet valve 5 and reversing valve 4 are executed as valves with a pusher rod 25 and are capable to be closed instantaneously by straight oncoming flow of the borehole fluid, which provides reliable operation of the section isolation valves. Consequently, it is possible to significantly simplify the design of the pump module and avoid losses of the borehole fluid as against utilization of gravity valves, used in corresponding patents.

Borehole fluid filtration zone 23 is arranged around the lower plunger 7 for filtration of the borehole fluid, periodically filling a cavity 24 in the pump module enclosure. Wherein said cavity 24 is formed by the difference in radial dimensions of plunger rod 10 and linear drive 2 connected to each other.

It should also be noted that the radial dimensions of pair of plungers 6 and 7 are assorted in a manner for providing approximate equality of the fluid volumes pumped (displaced) during upward stroke and downward stroke.

According to said invention named traveling valve 8, inlet valve 5 and reversing valve 4 are equipped with directional pusher rod 25 which contacts with locking element 26 and closed by the straight oncoming flow of the borehole fluid.

Pump module valves (FIG. 3) comprise cylindrical body 27 with locking element 26 inside of the cylindrical body, said locking element 26 is made in form of a ball. A motion of locking element 26 is enabled by means of pusher rod 25 with a plurality of recirculation holes 28 crossing a body of the pusher rod with an angle to a central axis of the pusher rod. Said embodiment providing that an area of increased hydraulic resistance is arranged within the pusher rod cavity 29, which creates a hydraulic pressure necessary for a translation movement of the pusher rod.

Figure 4:
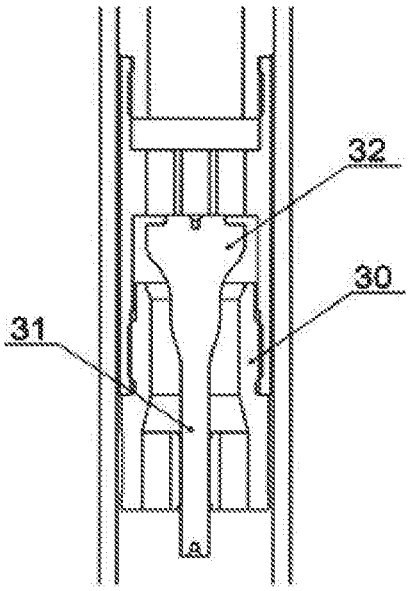
FIG. 4 shows the second variant of pumping module valve.

According to another variant of invention (FIG. 4), pump module valves comprise a cylindrical body 30 with locking element inside of the cylindrical body, which made in form of directional neck 31 with sealing cone 32, closing by a straight oncoming flow of the borehole fluid, named locking element is made in solid-metal form and consists on parts with a variable radial cross section.

Figure 3:
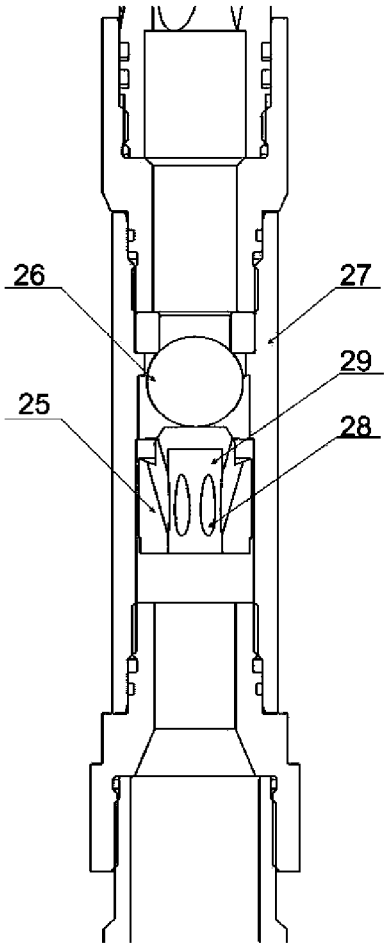
FIG. 3 shows the first variant of pumping module valve.

The locking element inside of the cylindrical body is made of materials with variable hardness. For example, locking element 26 is made of a material, hardness of which is greater than a hardness of pusher rod 25 in preferred variant of implementation (FIG. 3). In both said variants (FIG. 3 and FIG. 4), the pusher rod 25 or directional neck 31 are made or covered with inert, corrosion-resistant and friction material.

The method for operation of the Double Acting Linear Electrical Submersible Pump utilizing the pump module of the described design involves lowering of the said pump module together with the installation into a well and filling it with the borehole fluid with its subsequent displacement into the oil well tubing string cavity by means of reciprocal motion of plungers 6, 7 connected to movable part of linear drive 2, while both plunger strokes are operational.

The borehole fluid intake from the annulus is conducted during the downward stroke (FIG. 2), with upper plunger inlet valve 5 open and traveling valve 8 closed, while filling the double-volume of the cylinder 11 of the upper plunger 6 that is sufficient for one operating cycle. Herewith the borehole fluid is being pushed through the filtration zone 21 with installed filters and gravitational gas separation zone 22, arranged within the borehole fluid delivery channel 20 of the pump module. A volume of gravitational gas separation zone 22 is executed to be greater or equal to the volume of one operating cycle of the pump module, which provides effective separation of gas particles from liquid particles and brings them out to the annulus, as shown in FIG. 2. Simultaneously, during the downward stroke the fluid is pushed out from the second annular cavity 12 under plunger rod 13 of upper plunger 6 by means of common volume 14 arranged between the pair of plungers and the first annular cavity 9 connected to the common volume 14. Wherein the fluid is pushing out from the second annular cavity 12 towards high-pressure channels 19, arranged within separator 15 of downward and upward flows of the borehole fluid and further through reversing valve 4 into the oil well tubing string. The flow separator 15 is installed above cylinder 11 of upper plunger 6. During the return upward stroke (FIG. 1) with pumping plunger pair inlet valve 5 closed and traveling valve 8 open, under the effect of pressure created in cylinder cavity 11. The borehole fluid flow is spread towards common volume 14 located between the pair of plungers and, from analogy of the downward stroke (FIG. 2), is fed towards the oil well tubing string.

Also during the upward and downward strokes constant circulation of the borehole fluid is performed within lower plunger 7 (as shown in FIG. 1 and FIG. 2) by means of periodical filling of cavity 24 located in the pump module enclosure formed by a difference in radial dimensions of plunger rod 10 and linear drive 2 connected to each other. The borehole fluid filtration zone 23 with a set of filters is arranged in order to provide protection of the linear drive from mechanical impurities.

An embodiment of the claimed invention contributes to achievement of the mentioned technical result by providing simplification of the design while increasing the productivity of the pumping unit utilization by using the set of valves with absence of a complex system of channels for borehole fluid passage, which allows to regulate the fluid motion within the pump module cavity without losses even with its horizontal positioning in a well. Also the arrangement of filtration and gravitational gas separation zones provides possibility of protection from harmful effect of gas and mechanical impurities, containing in the borehole fluid.

The claimed method provides various options and alternative forms of embodiment. A particular embodiment is disclosed in the description and illustrated by means of the given graphic materials. Described embodiment of the invention is not limited to a particular disclosed form and may encompass all possible embodiments, equivalents and alternatives, within the limits of essential features disclosed in the claim.

What is claimed is:

1. A double acting linear electrical submersible pump, comprising:

a pump module with a traveling valve (8), a reversing valve (4) and an inlet valve (5), wherein said pump module comprising a pair of successively mounted plungers (6, 7) that forms an upper plunger (6) and a lower plunger (7), wherein said pair of plungers (6, 7) are connected to a movable part of a linear drive (2) and configured to displace an internal volume of a fluid of said pump module by means of a reciprocal motion of the linear drive, wherein the upper plunger (6) is equipped with the traveling valve (8) and said inlet valve (5), wherein said upper plunger (6) forms a first annular cavity (9) with a pump module enclosure, wherein a cylinder (11) of the upper plunger (6) is configured to collect a double volume of the fluid which is sufficient for one operating cycle of the pump module, wherein the cylinder (11) is installed under a separator (15) of a downward flow of the fluid (16) and an upward flow of the fluid (17), wherein the separator (15) comprising a low pressure channel (18) and a high pressure channel (19), wherein said low-pressure channel (18) is arranged in fluid communication with a fluid delivery channel (20) of the pump module, wherein said delivery channel (20) has a filtration zone (21) and a gravitational gas separation zone (22), wherein a volume of the gravitational gas separation zone (22) is greater or equal to the volume of the cylinder (11), wherein a plunger rod (10) of the lower plunger (7) is partially located inside of the cylinder (11) of the upper plunger (6) to form a second annular cavity (12), wherein said lower plunger (7) is designed as a labyrinth sealing of the movable part of the linear drive, wherein the pump module enclosure (3) contains a lower borehole fluid filtration zone (23), wherein said lower borehole fluid filtration zone (23) is arranged around a cavity (24) formed between the lower plunger (7) and the pump module enclosure (3), wherein the lower plunger (7) and the linear drive (2) are connected to each other within the cavity (24) formed between the lower plunger (7) and the pump module enclosure (3).

2. The double acting linear electrical submersible pump according to claim 1, wherein the first annular cavity (9) is arranged between the pump module enclosure (3) and an outer surface of the cylinder (11), wherein the second annular cavity 12 is formed around the plunger rod (10) of the lower plunger (7) under the upper plunger (6), wherein said first annular cavity (9) and second annular cavity (12) are connected by a common volume (14) arranged between the pair of successively mounted plungers (6,7).

3. A method of operation of a double acting linear electrical submersible pump comprising:

a) lowering a pump module (1) connected to a linear drive into a well;

b) filling said pump module (1) with a fluid, and displacing the fluid subsequently into a tubing string cavity by reciprocating an upper plunger (6), wherein the upper plunger (6) is connected to a lower plunger (7) to form a pair of plungers and is equipped with an integrated traveling valve (8) and a fixed inlet (5) valve, wherein the lower plunger (7) is connected to a movable part of the linear drive within a cavity (24) formed between the lower plunger (7) and a pump module enclosure (3), wherein both plunger strokes of said pair of plungers (6,7) are operating, wherein the radial dimensions of said pair of plungers (6, 7) provide approximately equal volumes of the fluid to be displaced during an upward stroke and a downward stroke of one operating cycle;

c) performing a fluid intake from an annular space during the downward stroke with the open inlet valve (5) and the closed traveling valve (8) of the upper plunger (6), filling a double volume of a cylinder (11) of the upper plunger (6) required for one operating cycle;

d) pushing the fluid through a filtration zone (21) and a gravity gas separation zone (22), wherein a volume of the gravity gas separation zone (22) is larger or equal to the volume of one operating cycle of the pump module, separating gas particles from the fluid during the motion through the gravity gas separation zone (22);

e) simultaneously during the downward stroke of the linear drive:

filling the cylinder (11) and displacing the fluid from a second annular cavity (12) into a first annular cavity (9), pushing the fluid towards high-pressure channels 19 arranged within a separator (15) of a downward flow of the fluid (16) and an upward flow of the fluid (17), the separator (15) being installed above the cylinder (11), pushing the fluid through a reversing valve (4) into the tubing string;

f) simultaneously during the upward stroke of the linear drive:

creating a pressure within the cylinder (11) with closed inlet valve (5) and opened traveling valve (8) of the upper plunger (6), displacing the fluid under an influence of the pressure created within the cylinder (11) towards a common volume (14) located between the pair of plungers (6,7);

g) during the upward stroke and downward stroke of the linear drive filtering the fluid within the cavity (24) formed between the lower plunger (7) and the pump module enclosure (3).

* * * * *